United States Patent [19]

Tholome

[11] Patent Number: 4,785,760

[45] Date of Patent: Nov. 22, 1988

[54] SPRAYER INSTALLATION

[75] Inventor: Roger Tholome, La Tronche, France

[73] Assignee: S A M E S S.A., Meylan, France

[21] Appl. No.: 136,844

[22] Filed: Dec. 22, 1987

[30] Foreign Application Priority Data

Jan. 2, 1987 [FR] France ..... 87 00007

[51] Int. Cl.[4] ..... B05B 1/28

[52] U.S. Cl. ..... 118/323; 118/302; 118/668; 901/43; 239/305; 239/587

[58] Field of Search ..... 118/323, 300, 305, 663, 118/302, 697; 901/43; 239/112, 124, 305, 750, 587

[56] References Cited

U.S. PATENT DOCUMENTS

| | | | |
|---|---|---|---|
| 3,450,092 | 6/1969 | Kock | 118/302 |
| 3,674,207 | 7/1972 | Carbonetti | 118/323 |
| 3,709,190 | 1/1973 | Von Gottberg | 901/43 |
| 4,278,046 | 7/1981 | Clarke | 118/323 |
| 4,313,475 | 2/1982 | Wiggins | 141/18 |
| 4,498,414 | 2/1985 | Kiba | 118/323 |
| 4,509,684 | 4/1985 | Schowiak | 239/124 |
| 4,630,567 | 12/1986 | Bambousek | 118/323 |
| 4,714,044 | 12/1987 | Kikuchi | 118/323 |
| 4,721,630 | 1/1988 | Takeo | 118/323 |

FOREIGN PATENT DOCUMENTS

| | | | |
|---|---|---|---|
| 773048 | 12/1967 | Canada | 118/360 |
| EP192338 | 8/1986 | European Pat. Off. | 118/305 |
| 2149323 | 6/1985 | United Kingdom . | |
| 2166982 | 5/1986 | United Kingdom . | |

*Primary Examiner*—Shrive Beck
*Assistant Examiner*—Vi Duong Dang
*Attorney, Agent, or Firm*—Sandler & Greenblum

[57] ABSTRACT

A sprayer installation suitable for spraying water-based paint includes a multi-axis robot carrying a sprayer. A conveyor carries objects to be sprayed past the robot. Respective circuits for distributing products to be sprayed comprise first connection devices at fixed locations within range of the robot. The robot carries a storage tank for the product to be sprayed at least during a spraying phase. This storage tank is connected to the sprayer to supply product to be sprayed to it. First complementary connection devices fitted to or communicating with the storage tank cooperate with the first connection devices of any selected distribution circuit.

24 Claims, 2 Drawing Sheets

SPRAYER INSTALLATION

BACKGROUND OF THE INVENTION

1. Field of the invention

The invention relates to an installation for spraying coating products such as paint of the type in which the object to be coated, carried by a conveyor, passes in front of the working area of a manipulator robot carrying a sprayer which sprays the coating product in the form of fine particles.

The invention is more particularly directed to a new arrangement making it possible to solve the problem of changing color when the objects passing in succession in front of the robot have to be painted different colors and the problem of providing the necessary galvanic isolation between the means for distributing the coating products and the sprayer means where the paint used has a low resitivity (water-based paint) and when the spraying means incorporate a high-tension voltage source for implementing electrostatic spraying.

2. Description of the prior art

A paint spraying installation in a production unit as large as an automobile factory, for example, generally comprises several closed loop paint distribution circuits which are very long (these circuits may pass right across part of the plant) and which make the connections between large paint storage tanks and the various spraying booths. It is therefore necessary to provide a circuit of this kind for each color and another circuit of the same kind for the solvent or cleaning product. For obvious safety reasons these circuits are electrically grounded.

In a spray booth supplied in this way, the objects to be painted (which are automobile bodies in the example under discussion) are carried by conveyor means through the booth in which is at least one robot carrying a paint sprayer and able to operate within a particular "working area" inside the booth. Use is routinely made of robots having up to six or even seven degrees of freedom or axes so that the sprayer can be oriented at will and caused to penetrate into certain less accessible parts of the object to be painted. For simple shapes a robot with only three of four degrees of freedom may be adequate.

The sprayer may be of the electrostatic type involving high rotation speeds, or of the pneumatic or hydrostatic type. The robot usually comprises an arm made up of several segments articulated to each other, the arm possibly being carried by a chassis movable lengthwise of the conveyor means. One of the usual problems to be overcome in this type of installation is that of changing color between two consecutive objects. In the automobile industry in particular there is no question of painting long series of bodies the same color. To the contrary, the more usual situation is that where the color has to be changed after virtually every body. This implies the possibility of implementing extremely rapid rinsing and drying cycles for the spraying means. To give an example, it may be necessary to change the color about once a minute and all the operations necessary for changing color can take about ten seconds.

In conventional installations as currently known all the coating product distribution circuits, a compressed air supply circuit and a cleaning product circuit are connected through selectively operable isolating valves to a manifold which has a common outlet branch connected to the sprayer.

To change color it is necessary to shut off the valve in the circuit for the coating product currently being used a particular (computed) time before the end of the current spraying phase and then to open the compressed air valve to expel the remaining product through the sprayer. The robot is then moved away from the object and oriented towards a recovery receptacle. The cleaning product valve is opened until the manifold and the sprayer are clean. This valve is then closed and the compressed air valve is opened again to expell the cleaning product contained in the manifold into the recovery receptacle. The opening of the compressed air valve is prolonged to dry the conduits and then, once it has been closed, the valve on another coating product circuit is opened to fill the manifold and the conduits until a little of the new color coating product is expelled from the sprayer. The robot is then turned back to face the new object to be sprayed.

If the installation comprises only a small number of different color coating products, three or four, for example, the manifold may be disposed relatively near the sprayer, on one of the final articulated segments of the robot arm, for example, each coating product being supplied through a flexible hose. On the other hand, if there are too many different coating products (there may be up to 20) this solution is no longer practicable and the manifold must then be fixed with its outlet connected to the sprayer by a single flexible hose. If the objects to be sprayed are bulky, which is the case with automobile bodies, the robots have to move over great distances parallel to the largest dimension of the objects to be sprayed, which may be five or six meters, for example. In this case the manifold is far away from the sprayer, up to ten meters, for example, which considerably increases the volumes of conduit to be cleaned and therefore the length of the color change sequences. It often becomes necessary in such cases to duplicate the supply circuits (manifolds, valves, conduits) in order to use part for spraying while the other part is undergoing a cleaning and color change cycle. Also, the quantities of the coating product and of the cleaning product wasted on each color change are important, in the order of several hundred cubic centimeters.

Furthermore, the installation is made more complex by the fact that, in order to procure a constant flowrate of the coating product during the end of the spraying phase in which the coating product is expelled by compressed air, it is necessary to provide a pressure regulator immediately upstream of the sprayer on the coating product circuit. Finally, as the sprayers generally have very small cross-section outlet orifices, to secure correct spraying, it is not always possible to eject all of the cleaning product through these orifices. For the cleaning of the manifold and the conduits to be effective and fast it is necessary to maintain turbulent flow and therefore a high speed combined with a high flowrate. To this end it is necessary to provide between the pressure regulator and the sprayer a large cross-section purging circuit and a purging valve through which the cleaning product flows to the recovery receptacle. Also, the pressure regulator and the purge valve being in the immediate vicinity of the sprayer, in an area that may contain a flammable gaseous mixture and that may be at a high-tension voltage when the sprayer is of the electrostatic type, this device is usually actuated by compressed air, calling for additional pneumatic hoses.

In the case of an electrostatic installation all these problems concerning color changes are accentuated where there is a requirement to use coating products of low resistivity, such as water-based paint, for example, while conserving the advantages of electrostatic spraying. In this case the sprayer is often held at a high-tension voltage and it is necessary to avoid short-circuits between the sprayer and the coating product distribution circuits that are electrically grounded. For the leakage current to be acceptable with the water-based paints currently used it would be necessary to use insulative conduits with a length/cross-section ratio that would be unacceptable because it would lead to extremely long color changing times and unrealistically large quantities of coating and cleaning product being wasted.

Also, when the coating product supply conduits and the purge circuits are filled with electrically conductive product,. the dielectric strength of the conduits must be sufficiently high to withstand the high-tension voltage applied. Also, the quantity of product that they contain represents a relatively large electrical capacity able to store a quantity of energy much higher than the tolerated limits.

To confront the problem specific to changing color with low-resistivity coating products, French Patent No. 2 572 662 proposes to fill an intermediate storage tank with just the quantity of paint needed for each application. This intermediate storage tank is fixed so that each color change entails cleaning out not only the storage tank but also all the conduits connected to it. Furthermore, in one embodiment isolation is re-established after filling by draining and drying a sufficient length of conduit upstream of the intermediate storage tank. This operation requires a prohibitive length of time on each color change.

The invention proposes to solve the problems of changing color by considerably simplifying the equipment situated between the distribution circuits and the sprayer, irrespective of the type of coating product used.

The invention also proposes to reduce the time necessary to change color, even when the number of different colors is large and the robot which moves the sprayer has to move over long distances because of the size of the objects to be sprayed.

In the specific instance of electrostatic spraying of low-resistivity coating products, the invention further proposes to solve in a particularly simple way the problem of isolating the electrostatic sprayer from the coating product distribution circuits, that are electrically grounded.

SUMMARY OF THE INVENTION

The present invention consists in a sprayer installation comprising at least one multi-axis robot, a sprayer carried by the robot, a conveyor adapted to carry objects to be sprayed past the robot, respective circuits for distributing products to be sprayed, like first connection means for each of said distribution circuits at fixed locations within range of the robot, a storage tank for product to be sprayed carried by the robot at least during a spraying phase and connected to the sprayer to supply thereto product to be sprayed, and first complementary connection means equipping or communicating with the storage tank and cooperable with the first connection means of any of the distribution circuits.

There are multiple embodiments corresponding to this definition. Thus the coating product storage tank may be fixed to the end of the robot arm. In this case it is sufficient for this arm to be able to orient itself on each color change towards the aforementioned connection means as well as towards other connection means of a cleaning product distribution circuit in order to clean the storage tank and then fill it with a coating product of a different color. It is equally possible to use as many storage tanks as there are different coating products. In this case, each storage tank may be separated from the robot arm and "hooked onto" its own distribution circuit to be refilled after use. This embodiment dispenses with the need for cleaning the storage tanks. Finally, an intermediate solution might consist in using only two removable storage tanks, one of the storage tanks being carried by the robot arm while the other is connected to the coating product and cleaning product distribution circuits to undergo a color change cycle.

In all cases, note that the quantity of coating product fed into the storage tank for each spraying phase has no need to be adjusted according to the dimensions of the object to be painted. The dimensions of the storage tank depend only on the ability of the robot to support and move at high speed a particular weight of coating product. If the robot is unable to support a storage tank of sufficiently large dimensions to contain all of the coating product needed for painting the entire object, it is perfectly feasible to envisage recharging this storage tank one or more times during the dead time of the spraying phase. If, on the other hand, the capacity of the storage tank can accommodate more coating product than is necessary for a spraying phase the excess quantity is re-injected into the corresponding distribution circuit at the beginning of the color change cycle.

The invention will be better understood and other advantages of the invention will emerge more clearly from the following description of several paint spraying installations in accordance with the invention given by way of example only and with reference to the appended diagramatic drawings.

DESCRIPTION OF THE PREFERRED EMBODIMENTS

Figure 1:
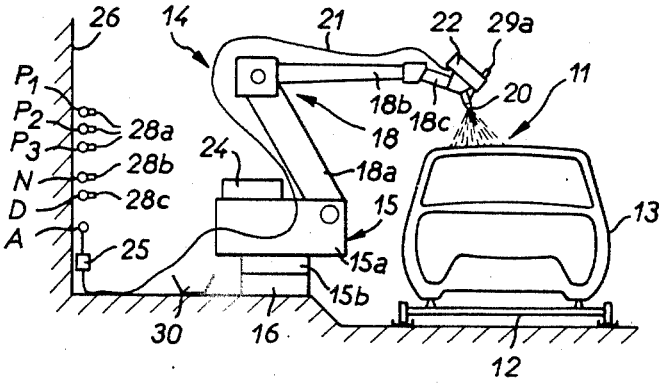
FIG. 1 is a schematic view of a sprayer installation during a paint spraying cycle, using a robot with several degrees of freedom and incorporating improvements in accordance with the invention.
Figure 2:
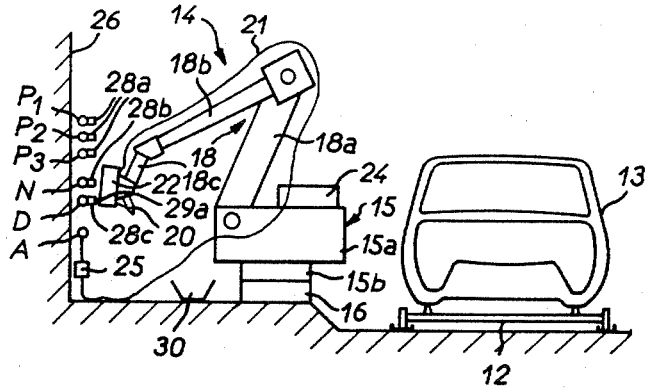
FIG. 2 is a schematic view analogous to figure 1 showing the position of the robot during a color change cycle.
Figure 3:
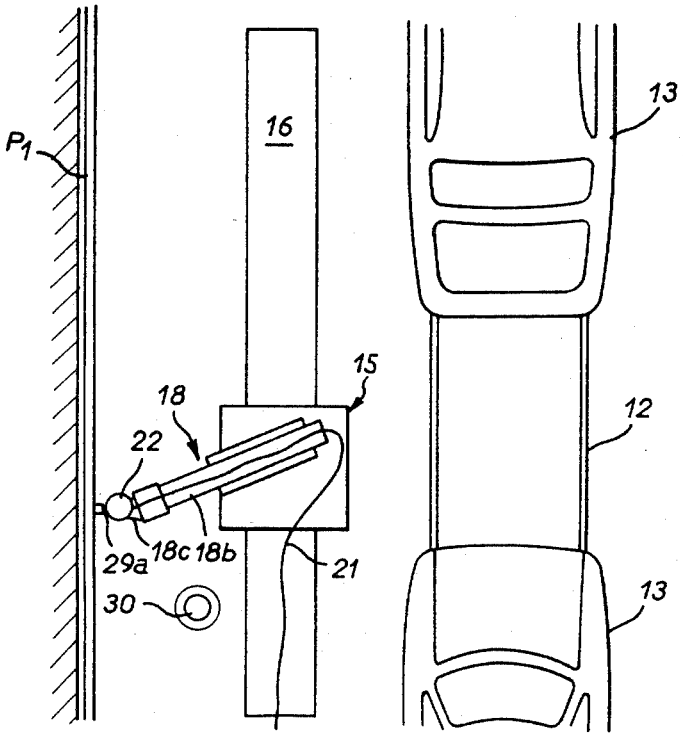
FIG. 3 is a plan view of FIG. 2.

Referring to FIGS. 1 through 3, a first embodiment of the invention comprises a paint spray booth 11 through which pass conveyor means 12 carrying objects 13 to be painted (automobile bodies in this case) past a robot 14 in close proximity thereto. This robot is of the multi-axis type, known in itself; it essentially comprises a chassis 15 movable along a guide 16 extending over a certain distance alongside the conveyor means and an arm 18 carried by the chassis and made up of several segments 18*a*, 18*b*, 18*c* articulated to each other. The chassis 15 itself comprises two parts 15*a*, 15*b* joined together by a vertical axis articulation enabling it to pivot on itself as seen are comparing FIGS. 1 and 2. The "working area" of the robot is anywhere in the booth that the robot can reach, in particular by means of the last segment 18*c* of its arm.

The segment 18*c* carries the coating product spraying means, in this instance a sprayer 20 supplied with compressed air by a flexible hose 21 and, in accordance with the invention, a coating product storage tank 22. In the case of an electrostatic sprayer installation, the robot may comprise a high-tension voltage generator 24 connected to the spray nozzle or to the bowl in the case of a sprayer of the type relying on a high rotation speed. In a conventional way the high-tension voltage generator 24 is fully controllable, by which is meant that its output voltage may be reduced to zero volts at any time and then re-established virtually instanteously, using highly conventional control means. This possibility of adjusting the high-tension voltage, although banal in itself, is of particular importance in the context of the invention since for each filling and/or cleaning sequence the sprayer is coupled up to the product distribution circuit, which is electrically grounded.

In the example now being described, the storage tank 22 is fixed onto the last segment of the robot and communicates with the sprayer 20. If the storage tank is too large to be mounted on the last segment, it can be mounted on the penultimate segment and connected to the sprayer by a flexible hose.

Conduits forming part of the various distribution circuits pass through the booth 11; they may be fixed along the length of a wall 26 of the latter, for example. Thus in the example shown there are three paint distribution circuits P1, P2 and P3 (these are for paints of different colors), a cleaning product distribution circuit N and a waste evacuation circuit D. There is also a compressed air supply circuit A to which the conduit 21 is connected via a valve 25. The circuits P1, P2 and P3 are provided with respective first connection means 28*a* which are similar (like to each other), and grouped together in the working area of the robot, that is the vicinity of the wall 26. Each of these first connection means of any of the circuits P1, P2, P3 is cooperable with first complementary connection means 29*a* carried by the storage tank 22. In the case of FIGS. 1 through 3, said first connection means of each circuit P1, P2 and P3 are simply and respectively constituted by a single connector part of the "ball-type self-closing quick-release connector" type well known to those skilled in the art whereas the first complementary connection means 29*a* consist only of another connector part of complementary structure adapted to connect in a fluid-tight way to one of the connector parts of circuit P1, P2 or P3. Likewise, the cleaning product distribution circuit N and the waste evacuation circuit D respectively comprise connection means 28*b*, 28*c* to the storage tank 22, in this instance identical to said first connection means of the circuits P1, P2 and P3 since they are made up from the same connector parts. All the connection means 28*a*, 28*b*, 28*c* are grouped very close to each other in the working area of the robot.

A waste recovery receptacle 30 is also provided in the working area, not far from the connection means 28*a*, 28*b* and 28*c*. This receptacle is designed to receive any product (paint or cleaning product) expelled in jet form by the sprayer 20.

Note that the compressed air hose 21 may communicate direct with the storage tank 22 if the robot is programmed so that it never places the pressurization air inlet at a level lower than the paint outlet, to prevent air being expelled directly by the sprayer, when it is opposite an object to be painted. A known system for monitoring the quantity of paint sprayed makes it possible to avoid complete emptying of the storage tank during spraying. Use may also be made of another type storage tank comprising a piston or a deformable membrane adapted to divide the internal space of the storage tank into two chambers. One chamber receives the product and the other is filled with air under pressure. In this case it is obvious that the first complementary connection means 29*a* communicate with the chamber receiving the product and the conduit 21 communicates with the other chamber so as to push back the piston or the membrane as the product is taken off by the sprayer 20 or by the first complementary connection means 29*a*.

The operation of the installation will now be described. At the end of a spraying phase shown in FIG. 1 when the valve 25 is open to enable compressed air to propel the coating product to the sprayer 20 where it is sprayed towards the object to be painted the robot 15 turns on its axis to bring the storage tank 22 into the area of the booth containing the various connection means described hereinabove. If it is necessary to change the color of the paint, for example to change from the paint distributed via P1 to the paint distributed via P2, the robot begins by connecting the storage tank to circuit P1 in order to re-inject into it the excess paint or at least as much as possible of this excess, monitoring the quantity expelled to prevent injecting air into the circuit. The robot then places the storage tank 22 in communication with the circuit 21 distributing the cleaning product N, the three-way valve 25 being vented to the atmosphere to enable filling of the storage tank. When the storage tank is filled the robot connects it, via the same connection means, to the waste evacuation circuit D and the valve 25 is again connected to evacuate the cleaning product in this circuit. The previous two operations are repeated as many times as necessary until the storage tank is clean. After this the robot moves the sprayer 20 to the receptacle 30 and compressed air is again injected to expel a little of the cleaning product through the sprayer in order to clean it. The robot then connects the storage tank 22 to the distribution circuit P2 while circuit 21 is again vented to atmosphere by the valve 25 to enable the storage tank to be filled with new paint. After this the robot moves the sprayer 20 over to the receptacle 30 in order to spray into it a small quantity of the product and thus eliminate the last traces of the cleaning product. The color change cycle is then finished and the robot can again turn on its axis to paint a new body.

In the case of an electrostatic sprayer installation the high-tension voltage is reduced to zero before the color change cycle is started and is not re-established until it has finished. It is clear that through the spraying time the high-tension voltage is totally isolated from the various distribution circuits that are electrically grounded since there is no product conduit between them.

It will also be appreciated that the equipment carried by the robot is highly simplified. The conventional purge valves and purge circuit are eliminated since, on cleaning out the storage tank 22, the products are fed in and evacuated essentially by the connection means described hereinabove, which have a much larger cross-section than the sprayer 20. The cleaning product is admitted into the sprayer 20 only in very small quantities, for cleaning just the sprayer. Likewise, no pressure regulator is needed since the installation does not comprise any long pipes in which paint is propelled by compressed air at the end of the spraying period. Here the paint is propelled into the storage tank where there is no variation in head loss.

Figure 4:
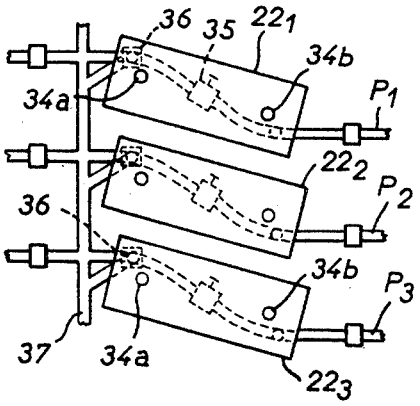
FIG. 4 is a schematic showing one embodiment of the invention.
Figure 5:
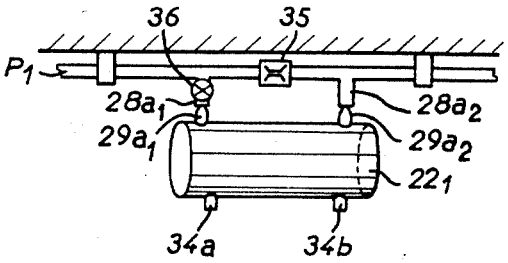
FIG. 5 is a plan view of FIG. 4.

FIGS. 4 and 5 where analogous parts carry the same reference numbers show an embodiment in which the color change cycle can be very significantly abbreviated, as it does not require any cleaning. The installation is provided with as many coating product storage tanks $22_1$, $22_2$, $22_3$, etc as there are distribution circuits $P_1$, $P_2$, $P_3$, etc. Thus these storage tanks are not fixed onto the robot but are connected to it by means of second connection means (not shown) carried by the robot and cooperable with second complementary connection means 34*a*, 34*b* provided on each storage tank. These connection means are made up from the same connector parts as those used in the first embodiment described. However, the second connection means provided on the robot comprise two connector parts spaced by a predetermined distance while the second complementary connection means 34*a*, 34*b* also comprise two corresponding connector parts spaced by the same distance in order to fit to the parts carried by the robot. Once the storage tank is in place on the robot one of the connector parts of the storage tank is connected to the compressed air supply while the other is connected to the sprayer. Each storage tank may be of the piston or deformable membrane type described hereinabove.

The aforementioned first connection means of each distribution circuit P1, P2 or P3 also comprise two connector parts $28a_1$, $28a_2$. These are spaced by a predetermined distance with one on each side of a restriction 35 connected in series into the corresponding circuit P1, P2 or P3, this circuit being as usual of the continuous circulation closed loop type.

Analogously, said first complementary connection means provided on each storage tank comprise two other connector parts $29a_1$, $29a_2$ spaced by the same distance lengthwise of said storage tank.

In an advantageous arrangement the height of the circuits P1, P2 and P3 varies to each side of the restriction 35. The arrangement is such that the two connector parts $28a_1$, $28a_2$ are disposed at different levels, the connector part $28a_1$ at the higher level being downstream of the other connector part relative to the direction in which the coating product circulates in the corresponding distribution circuit. Also, the connector part $28a_1$ on the downstream side is connected to the distribution circuit through the intermediary of a selectively operated three-way valve 36 the other outlet of which communicates with a discharge circuit 37. This latter circuit is common to all the valves 36. The operation of this installation will now be described.

When the robot has finished painting an object and it is necessary to change color it "hooks up" the storage tank to said first connection means $28a_1$, $28a_2$ of the distribution circuit of the corresponding color. The robot then takes up the storage tank connected to another circuit corresponding to the new color. The robot is then immediately ready to paint the next object.

During this time the storage tank that has just been "hung up" is gradually filled, the corresponding valve 36 being in communication with the discharge circuit 37. Because a slight head loss is created in the corresponding distribution circuit by the restriction 35 the paint fills the storage tank until a small quantity is evacuated from it via the discharge circuit 37. At this time the storage tank is full and again ready for use. The valve 36 is then switched over and the paint continues to flow slowly through the storage tank until the robot takes up that storage tank again. The circulation of paint in the storage tank prevents the various constituents of the paint settling out. The high-tension voltage is reduced to zero throughout the hanging up phase of one storage tank and the taking up phase of another storage tank, of course. Two storage tanks may be provided for each color, so as to further limit the dead time if two consecutive objects are to be painted the same color or if a storage tank does not have sufficient capacity for painting all of an object.

Figure 6:
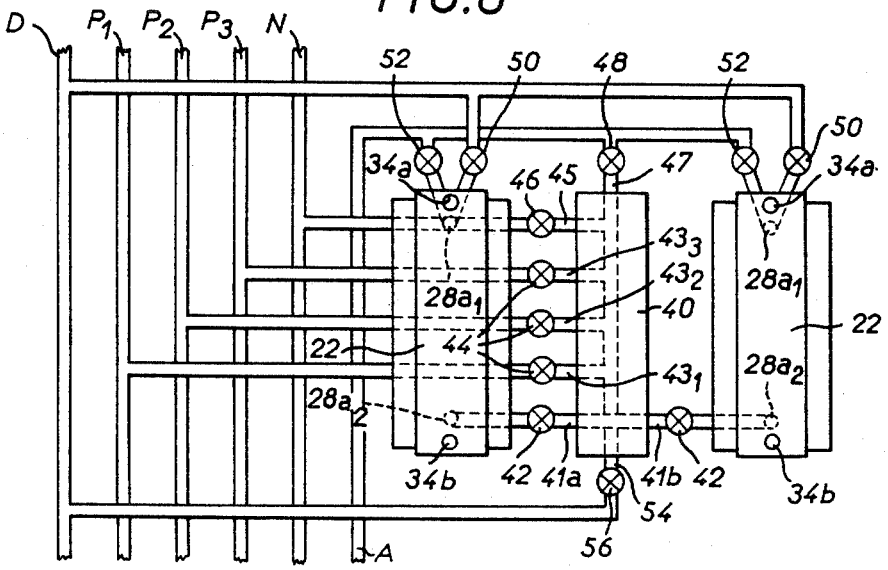
FIG. 6 is a schematic view showing another embodiment of the invention.
Figure 7:
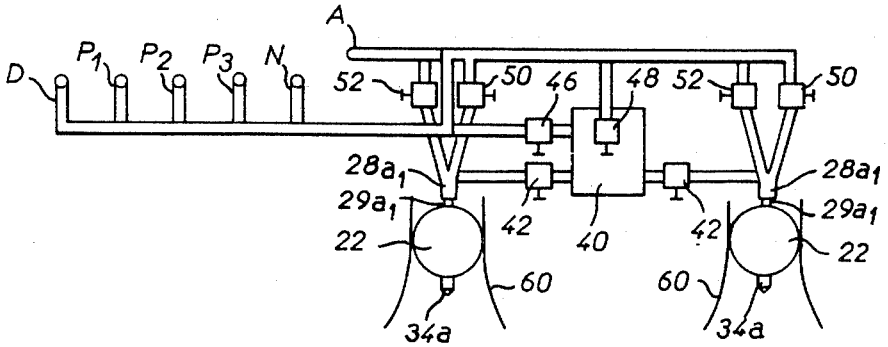
FIG. 7 is a plan view of FIG. 6.

The embodiment of FIGS. 6 and 7 shows a solution mid-way between the previous two, to the extent that it comprises only two storage tanks (or at least one pair of such storage tanks) and rinsing and drying means. The two storage tanks 22 are similar to those of the embodiment of FIGS. 4 and 5. Thus they each comprise first complementary connection means $29a_1$, $29a_2$ and second complementary connection means 34*a*, 34*b* each comprising two connector parts. The robot is provided with second connection means similar to those of the embodiment of FIGS. 4 and 5. The two storage tanks are designed to be "hooked onto" respective receptacles each comprising the previously mentioned first connection means $28a_1$, $28a_2$ cooperable with said first complementary connection means provided on the storage tanks. These first connection means also comprise two connector parts each.

As in FIG. 1, the installation comprises coating product distribution circuits P1, P2, P3, a cleaning product distribution circuit N, a waste evacuation circuit D and a compressed air supply circuit A. The storage tanks are supplied sequentially and selectively through the intermediary of a distributor-manifold 40 comprising two outlets 41*a*, 41*b* connected by selectively operated valves 42 to the first connection means and a certain number of inlets, including three inlets $43_1$, $43_2$, $43_3$ connected by selectively operated valves 44 to circuits P1, P2, P3. It further comprises an inlet 45 connected by a selectively operated valve 46 to the cleaning product distribution circuit N and an inlet 47 connected by a selectively operated valve 48 to the compressed air supply circuit A.

For each of the two storage tank receptacles, one ($28a_2$) of the two connector parts of the first connection means is connected to an outlet 41*a* or 41*b* of the distributor-manifold and the other ($28a_1$) is connected to the waste evacuation circuit D by a selectively operated valve 50 and to the compressed air supply circuit A by a selectively operated valve 52. The distributor-manifold 40 further comprises another outlet 54 connected by a selectively operated valve 56 to the waste evacuation circuit D. For each storage tank receptacle, the connector part ($28a_2$) of said first connection means which is connected to the outlet of the distributor-manifold is at a lower level than the other connector part ($28a_1$) connected to the waste evacuation circuit D and to the compressed air supply circuit A.

Each storage tank receptacle can be provided with guides 60 to facilitate the approach and correct positioning of the storage tank in the case where the robot does not provide the necessary accuracy of positioning. Such guides may be provided in the vicinity of the storage tank supports or equally well on the robot itself. Such guides may of course be used in installations as shown in FIGS. 1 through 5. The operation of the embodiment shown in FIGS. 6 and 7 will now be described.

When the robot has finished painting an object it "hangs up" one of the storage tanks 22 at one of the two locations provided for this purpose. It can then take up the second storage tank before turning back to paint the next object. During this time the distributor-manifold 40 carries out a cleaning and refilling cycle on the previous storage tank. To this end the excess paint in this storage tank is first re-injected into the circuit P1, P2 or P3 for the corresponding color by opening the corresponding valves 52, 42 and a valve 44. The storage tank is then cleaned by injecting the cleaning product through the valve 46, the distributor-manifold and the same valve 42, the corresponding valve 50 being open and the corresponding valve 52 being closed. After a phase in which the storage tank is dried by circulating air, by closing the valve 46 and opening the valve 48, it is placed in communication with the circuit of the new paint, through the intermediary of one of the valves 44 and the distributor 40, until a small quantity of excess paint is evacuated into the circuit D. After the valves 42, 44, 50 are closed the storage tank is ready to be used again. The cycle ends with the cleaning and drying of the distributor-manifold itself.

Although the embodiments of the invention have been described in the case of spraying (electrostatic or otherwise) liquid product such as paint, it goes without saying that it is equally applicable to powdered products such as powder paint, for example. It then suffices for the mobile intermediate storage tank or tanks and the transport, spraying, cleaning, recovery, etc means to be adapted in ways well known to those skilled in the powder spraying art to suit the relevant powder products. For example, it suffices to substitute for pressurization of the storage tank fluidization of the powder by feeding air through a porous bottom, to substitute for cleaning by means of solvent blowing out with compressed air, to substitute for self-closing ball-type connectors known elastic sleeve valves, to substitute for the waste receptacle a suction hood fitted with a separator filter, etc.

The foregoing description has made virtually exclusive reference to changing the coating color, but it is obvious that these changes can also relate to the nature of the product constituting the coating.

It is to be understood that the invention is in no way limited to the embodiments described hereinabove. In particular, if the structure of the paint sprayer is relatively simple (air sprayer) it (or part of it) may be combined with the storage tank. In this case the complementary second connection means of each storage tank comprise a connector part cooperable with a connector part of the robot communicating with a compressed air supply while the storage tank itself carries a dedicated sprayer communicating with the interior of the storage tank.

I claim:

1. Sprayer installation comprising at least one multi-axis robot, a sprayer carried by said robot, a conveyor adapted to carry objects to be sprayed past said robot, respective circuits for distributing products to be sprayed, like first connection means for each of said distribution circuits at fixed locations within range of said robot, a storage tank for product to be sprayed carried by said robot at least during a spraying phase and connected to said sprayer to supply thereto product to be sprayed, and first complementary connection means equipping or communicating with said storage tank and cooperable with said first connection means of any of said distribution circuits.

2. Installation according to claim 1, comprising a single storage tank fixed to said robot at a position near said sprayer.

3. Installation according to claim 2, comprising a cleaning product distribution circuit and means situated in range of said robot for connecting said cleaning product distribution circuit to said storage tank.

4. Installation according to claim 2, comprising a waste evacuation circuit and means situated in range of said robot for connecting said waste evacuation circuit to said storage tank.

5. Installation according to claim 2, comprising a waste recovery receptacle situated in range of said robot and adapted to receive product rejected by said robot.

6. Installation according to claim 1, wherein the number of said storage tanks is at least as large as the number of said distribution circuits, said robot comprises second connection means, second complementary connection means are provided on each storage tank and said second connection means on said robot are cooperable with said second complementary connection means on each storage tank.

7. Installation according to claim 6, wherein each distribution circuit is of the kind in which the product circulates continuously in use and comprises a flow restrictor device, said first connection means comprise two first connector parts spaced by a predetermined distance and disposed one on each side of said flow restrictor device and said first complementary connection means comprise two first complementary connector parts spaced by said predetermined distance lengthwise of said storage tank.

8. Installation according to claim 7, wherein said two first connector parts are disposed at different levels with that at the higher level downstream of that at the lower level relative to the direction in which the product circulates in said circuit.

9. Installation according to claim 7, further comprising a three-way valve in each distribution circuit and a discharge circuit to which an outlet of each three-way valve is connected and wherein said first connector part downstream of the other first connector part relative to the direction in which the product circulates in said circuit is connected to said circuit by said three-way valve.

10. Installation according to claim 9, comprising a single discharge circuit common to all said three-way valves.

11. Installation according to claim 1, comprising at least two storage tanks, two storage tank receptacles, first connection means on each receptacle, first complementary connection means on each storage tank cooperable with said first connection means, second connection means on said robot, second complementary connection means on each storage tank cooperable with said second connection means, a set of valves, cleaning product distribution circuit, a waste evacuation circuit, a compressed air supply circuit and a distributor-manifold connected by said set of valves to said distribution circuits for product to be sprayed, to said cleaning product distribution circuit, to said waste evacuation circuit, to said compressed air supply circuit and to said two storage tank receptacles.

12. Installation according to claim 11, wherein said first connection means of each receptacle comprise two connector parts spaced by a predetermined distance respectively connected by valves of said set of valves to an outlet of said distributor-manifold, to said waste evacuation circuit and to said compressed air supply circuit and wherein said first complementary connection means of each storage tank comprise two connector parts spaced by said predetermined distance.

13. Installation according to claim 12, wherein said distributor-manifold comprises respective inlets connected by valves of said set of valves to said distribution circuits for products to be sprayed, to said cleaning product distribution circuit ana to said compressed air supply circuit and an outlet connected by a valve of said set of valves to said waste evacuation circuit.

14. Installation according to claim 1, comprising respective guides disposed around each of said first connection means.

15. Installation according to claim 12, wherein said connector part of said first connection means connected to said outlet of said distributor-manifold is disposed at a lower level than the other connector part of said first connection means connected to said waste evacuation circuit and to said compressed air supply circuit.

16. Installation according to claim 6, further comprising a compressed air supply circuit and respective connector parts on said robot connected to said compressed air supply circuit and said sprayer, and wherein said second complementary connection means on each storage tank comprise two connector parts spaced by a predetermined distance one of which is cooperable with said connector part on said robot connected to said compressed air supply circuit and the other of which is cooperable with said connector part on said robot connected to said sprayer.

17. Installation according to claim 11, further comprising a compressed air supply circuit and respective connector parts on said robot connected to said compressed air supply circuit and said sprayer, and wherein said second complementary connection means on each storage tank comprise two connector parts spaced by a predetermined distance one of which is cooperable with said connector part on said robot connected to said compressed air supply circuit and the other of which is cooperable with said connector part on said robot connected to said sprayer.

18. Installation according to claim 6, further comprising a compressed air supply circuit and a connector part on said robot connected to said compressed air supply circuit and wherein said second complementary connection means on each storage tank comprise a connector part cooperable with said connector part on said robot connected to said compressed air supply circuit and said storage tank carries a dedicated sprayer.

19. Installation according to claim 11, further comprising a compressed air supply circuit and a connector part on said robot connected to said compressed air supply circuit and wherein said second ccmplementary onnection means of each !sorage tank comprise a connector part cooperable with said connector part on said robot connected to said compressed air supply circuit and said storage tank carries a dedicated sprayer.

20. Installation according to claim 1, comprising a high-tension voltage source connected to said robot and means for disabling said high-tension voltage source when said sprayer is inoperative.

21. Installation according to claim 20, wherein said distribution circuits for product to be sprayed are adapted to contain different color water-based paint.

22. Installation according to claim 1, wherein each storage tank comprises divider means dividing it into two chambers of which one is adapted to contain a product to be sprayed and the other is adapted to be connected to a compressed air supply circuit.

23. Installation according to claim 22, wherein said divider means comprise a piston.

24. Installation according to claim 22, wherein said divider means comprise a deformable membrane.

* * * * *